US005984583A

United States Patent [19]

Craigmile et al.

[11] Patent Number: 5,984,583

[45] Date of Patent: Nov. 16, 1999

[54] METHODS AND APPARATUS FOR DIRECTIONALLY DRILLING A BORE AND PLACING PIPE

[76] Inventors: Murray Penman Craigmile, 31 Willow Springs Crescent, Sylvan Lake, Alberta, Canada, T4S-1GI; Michael Schwager, 707 Belgrade Ave. N., Mankato, Minn. 56003

[21] Appl. No.: 08/917,398

[22] Filed: Aug. 25, 1997

Related U.S. Application Data

[63] Continuation of application No. 08/770,574, Dec. 19, 1996, abandoned.

[51] Int. Cl.[6] ..... E21B 11/02

[52] U.S. Cl. ..... 405/184; 175/19

[58] Field of Search ..... 405/184, 174, 405/154; 175/257, 170, 171, 325.1, 62, 22, 23, 19

[56] References Cited

U.S. PATENT DOCUMENTS

| | | | |
|---|---|---|---|
| 3,996,758 | 12/1976 | Cherrington | 405/184 |
| 4,117,895 | 10/1978 | Ward et al. | 405/184 |
| 4,124,082 | 11/1978 | Garver | 405/184 |
| 4,319,648 | 3/1982 | Cherrington | 405/184 |
| 4,671,703 | 6/1987 | Schmidt | 405/184 |
| 4,732,222 | 3/1988 | Schmidt . | |
| 4,833,974 | 5/1989 | Schmidt . | |
| 4,871,034 | 10/1989 | Schmidt . | |
| 4,905,773 | 3/1990 | Kinnan | 175/19 |
| 4,938,297 | 7/1990 | Schmidt . | |
| 4,953,626 | 9/1990 | Puttmann et al. . | |
| 4,981,181 | 1/1991 | Hesse . | |
| 5,010,965 | 4/1991 | Schmelzer . | |
| 5,042,158 | 8/1991 | Schmetzer . | |
| 5,074,364 | 12/1991 | Hesse . | |
| 5,095,998 | 3/1992 | Hesse et al. . | |
| 5,096,000 | 3/1992 | Hesse . | |
| 5,110,237 | 5/1992 | Hesse . | |
| 5,125,462 | 6/1992 | Hesse . | |
| 5,127,481 | 7/1992 | Hesse . | |
| 5,148,878 | 9/1992 | Schmidt et al. . | |
| 5,234,061 | 8/1993 | Hesse . | |
| 5,238,072 | 8/1993 | Hesse . | |
| 5,289,887 | 3/1994 | Puttmann et al. . | |

*Primary Examiner*—David Bagnell
*Assistant Examiner*—Frederick L. Lagman
*Attorney, Agent, or Firm*—Merchant & Gould P.C.

[57] ABSTRACT

The present invention provides an apparatus and method for directional drilling and a method and apparatus for placing pipe in a directionally drilled bore. The present invention provides a launch tube which is placed into unstable soil. The tube is fitted with a unique cutting shoe which forces soil both into and out of the tube to prevent the tube from becoming obstructed. Preferably, the launch tube extends to bedrock or stable soil. Once the launch tube is placed a directional drill is moved through the tube and into the bedrock so that the bore may be directionally drilled in the bedrock. Once the bore is established a pipe, or a plurality of pipes, may be placed into the tube using known techniques.

11 Claims, 3 Drawing Sheets

METHODS AND APPARATUS FOR DIRECTIONALLY DRILLING A BORE AND PLACING PIPE

This is a Continuation of application Ser. No. 08/770,574, filed Dec. 19, 1996, now abandoned which application are incorporated herein by reference.

FIELD OF THE INVENTION

The present invention is directed toward directional drilling and in particular is directed toward using directional drilling to assist in placing underground pipe. The present invention also relates to providing a stable launch tube to permit drilling within unstable soils.

BACKGROUND

Drilling a hole in soil is generally accomplished with a drill bit. Drill bits may also be configured to directionally drill holes within soil. The drill bit digs the soil and then the soil is conveyed up and out of the bore. It is difficult to drill in unstable soil. Many difficulties are raised by drilling in unstable soil. One of the difficulties is that the unstable soil tends to impede the drill bit. Also, it is difficult to convey the unstable soil out the hole as it is being drilled. Further complicating matters is that after the hole is drilled in unstable soil it has a tendency to collapse.

Unstable soils, such as gravel, are often found adjacent to rivers or streams. Thus, directionally drilling is not typically an option available when it is desired to place a bore underneath a river or stream.

In the prior art, pipe was placed in soil by first digging a trench and placing the pipe within the trench. This technique worked well for both stable and unstable soils. However, digging a trench and placing a pipe within it has many disadvantages, not the least of which is that the technique is extremely costly and time consuming.

Digging a trench is a known technique of the prior art to place pipe underneath rivers or streams. To dig a trench under a river or stream, the river or stream must be dammed up to permit backhoes to access the area for digging. If the river or stream is very deep or wide, it may have to be partially dammed so that trenches may be dug on opposite sides of the river. Further, environmental regulations restrict work on placing a pipe underneath a waterway to narrow windows of time. For example, environmental regulations often forbid work when fish are spawning, or during fishing season. Also, the location of the pipeline may be restricted as not to disturb environmentally fragile spawning grounds. All of the difficulties associated with placing pipe underneath a river extend the time it takes to place pipe under such circumstances to a year or more.

Pipes may be placed in stable or unstable soils without digging a trench by ramming the pipe into the soil and then clearing the soil from the pipe with, for example, compressed air. This is generally known as "trenchless" pipe placement. However, such "trenchless" placement of pipes may only be accomplished in a straight line. Thus, problems exist when the pipe which is to be placed is not intended to move in a straight line. Line, for example if it is desired to place a pipe underneath a river or within a metropolitan area.

There are many different types of pipe rammers. Pipe rammers typically ram pipes directly into soil. An example of a pipe ramming machine is described in U.S. Pat. No. 5,289,887 entitled "Method of Operating an Earth Boring Machine." This machine operates by directly ramming pipe into soil with pneumatic power and clearing soil from the pipe.

When ramming pipe the prior art provides that a cutting shoe may be positioned on the outside of the tube. The cutting shoe is slip fit to the outside of the pipe and held to the pipe by deformation of the shoe. The shoe and pipe combination is designed such that the soil is forced into the lumen of the tube as it is rammed. The soil is then removed from the lumen of the tube and the pipe is put in use.

A need exists to improve the placement of pipe in difficult areas. A need also exists to permit direction drilling in unstable soils.

SUMMARY OF THE INVENTION

The present invention provides a launch tube for ramming into soil and for use with a directional drilling device. The launch tube includes an elongated tube having a distal end, a proximal end and a lumen therebetween. The tube also has an inner diameter and an outer diameter. A first tubular shoe which has an outer diameter equal to or less than the inner diameter of the elongated tube is plug welded within the elongated tube at its distal end. The launch tube also includes a second tubular shoe which has an inner diameter equal to or greater than the outer diameter of the elongated tube and the second shoe is plug welded to the elongated tube at the distal end of the elongated tube.

In the preferred embodiment, the shoe is configured to force soil both into the lumen of the elongated tube and away from the lumen of the elongated tube.

The present invention also provides a method for placing an underground pipe beneath the surface of the earth which includes providing a launch tube having a proximal end and a distal end and ramming the launch tube into soil at a predetermined angle. Soil is cleared from the lumen of the launch tube. A directional drilling tube is then passed through the lumen of the launch tube to drill a bore which has an associated diameter. An underground pipe is then passed through the launch tube and through the bore.

DESCRIPTION OF THE PREFERRED EMBODIMENT

The present invention provides an apparatus and method for directional drilling and a method and apparatus for placing pipe in a directionally drilled bore. The present invention provides for a launch tube which is placed into unstable soil using any known ramming technique. The launch tube provides a stable bore from which directional drilling can commence. The stable bore is created by ramming a tube into the unstable soil at a predetermined angle. The tube is fitted with a unique cutting shoe which forces soil both into and out of the tube to prevent the tube from becoming obstructed. During the ramming process the tube is cleared of the unstable soil. Preferably, the launch tube extends to bedrock. Once the launch tube is placed, the directional drill is moved through the tube and into the bedrock so that the bore may be directionally drilled in the bedrock. If necessary, an exit tube also may be provided to connect the directionally drilled bore to the surface. Once the bore is established a pipe, or a plurality of pipes, may be placed into the tube using known techniques.

Thus, the present invention permits directional drilling within unstable soils. It is to be understood that ramming a launch tube into unstable soil prior to directionally drilling a bore is not limited to placement of pipe within the bore. The technique can be used to explore for minerals or other natural resources using known techniques. In the preferred embodiment, however, the bore is used to place pipe.

The present invention is particularly useful in placing pipe underneath rivers or streams. The present invention avoids the requirement of the prior art that the river or stream be dammed, and also minimizes the time required to place the pipe.

Now with reference to the drawings, where like elements are numbered alike, there is shown a schematic of a pipe ramming device 10 placing a launch tube 12 into unstable soil 14. FIGS. 3 through 6 illustrate a technique for placement of pipe according to the present invention. Unstable soil 14 is typically gravel, although the present invention can be used in other soils as well. Ramming device 10 may be of the type described in U.S. Pat. No. 5,289,887 which is incorporated herein by reference. In the preferred embodiment, ramming device 10 is positioned to ram pipe into unstable soil 14 at an angle $\alpha$ that is preferably and approximately a 15 degree angle.

Figure 1:
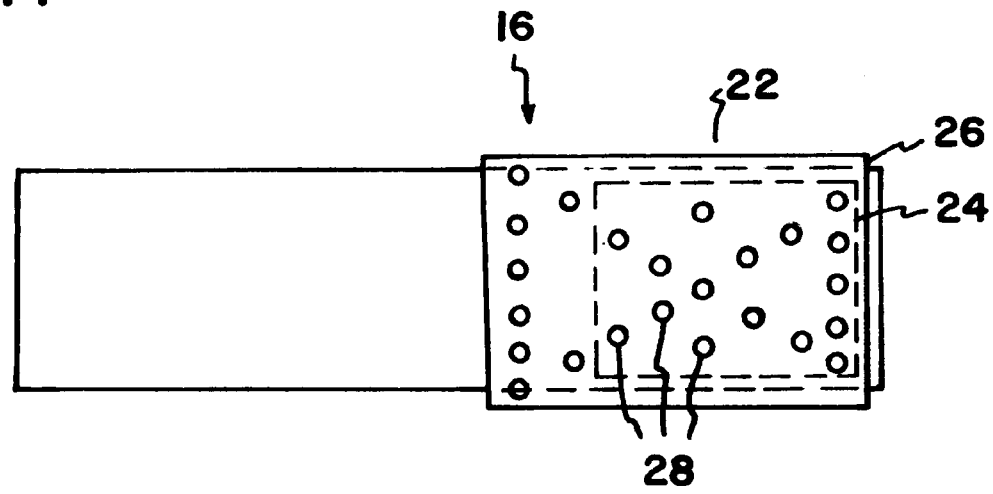
FIG. 1 is a side view of a launch tube with a cutting shoe according to the present invention.
Figure 2:
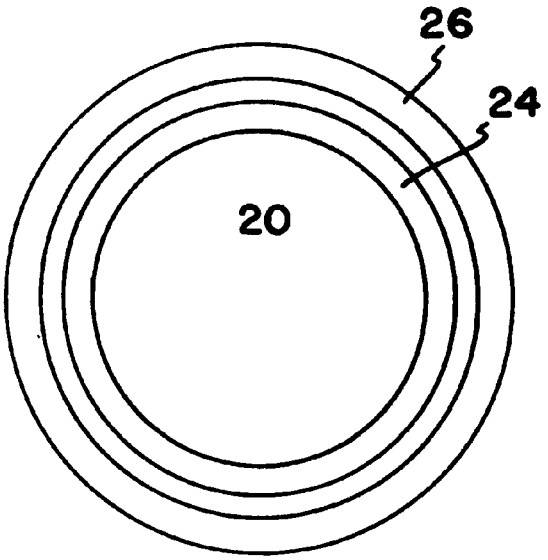
FIG. 2 is an end view of the launch tube of FIG. 1.

Launch tube 12 is generally cylindrical having distal and proximal ends 16 and 18, respectively, and a lumen 20 therebetween. As shown in FIGS. 1–2, distal end 16 of launch tube 12 is provided with a cutting shoe 22 which prevents lumen 20 from collapsing at distal end 16 as it is being rammed into unstable soil 14. In the preferred embodiment, cutting shoe 22 includes an inner shoe 24 and an outer shoe 26. Inner shoe 24 is preferably shorter than outer shoe 26. Inner and outer shoes 24 and 26 are attached to distal end 16 of launch tube 12 with a plurality of plug welds 28. In the preferred embodiment, plug welds 28 are formed by drilling one inch diameter holes through outer shoe 26, the distal end of launch tube 12 and inner shoe 24. The holes are aligned and filled with welding material. The cutting shoe may sharpened to facilitate ease of entry into the unstable soil. In the preferred embodiment, the plug will form a diamond pattern as best shown in FIG. 1.

Inner and outer shoes 24 and 26 are configured to push the unstable soil into and away from the lumen of launch tube 12. In the preferred embodiment, half of the soil is pushed into lumen 20 of launch tube 12 and half is pushed away from lumen 20 of launch tube 12. By deflecting the soil both into and away from lumen 20 the present invention provides significant advantages over the prior art. One such advantage is seen when ramming launch tube 12 through unstable soil 14 and a large rock or boulder is encountered. When the rock or boulder is encountered, the unique cutting shoe will tend to break it, without launch tube 12 deviating from its path. In contrast, the prior art cutting shoe would deflect the rock into the lumen of the pipe being rammed, thereby causing a risk that the lumen will become obstructed.

Launch tube 12, as well as inner and outer shoes 24 and 26, are typically constructed from steel tubing of the type used for steel pipeline.

Figure 3:
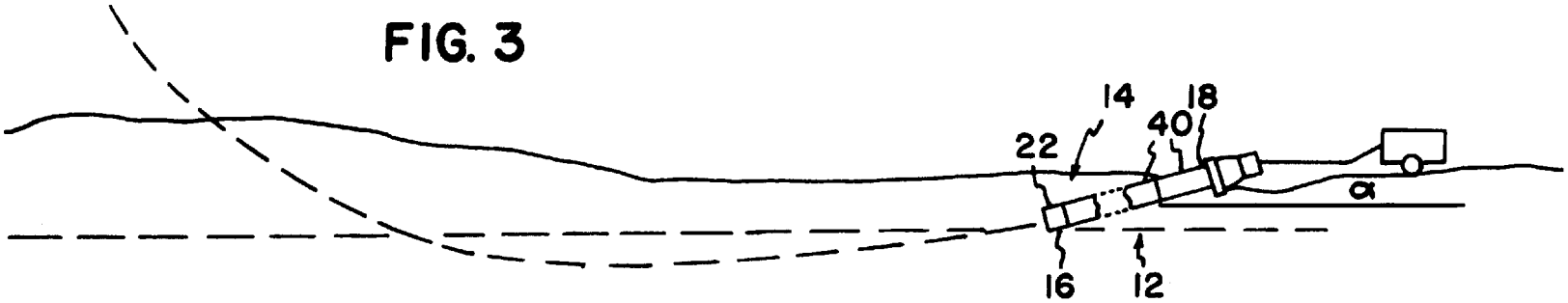
FIG. 3 is a schematic of the launch tube of FIG. 1 being rammed into unstable soil.

Launch tube 12 is positioned on rammer 10 and rammed into unstable soil, as shown in FIG. 3. Launch tube 12 is typically made up of segments 40. In one preferred embodiment the segments are 40 feet in length. Typically, each segment has a wall thickness of ⅜ of an inch to a full inch depending on the inner diameter and length of the pipe to be rammed. The inner diameter of the launch tube is dependent upon the size of the bore which needs to be created. The size of the bore will vary depending on the pipe to be placed therein. However, the launch tube needs to be at least 4 inches greater in diameter than the intended bore diameter so that the tools which are going to be sent through the launch tube will fit. Segments of launch tube 40 are rammed into unstable soil until the launch tube reaches stable soil, which is preferably bedrock. In some applications, it may take in excess of 450 feet of launch tube before stable soil such as bedrock is reached. Segments of launch tube 12 are welded together using known techniques to extend launch tube 12 to its desired length.

Figure 4:
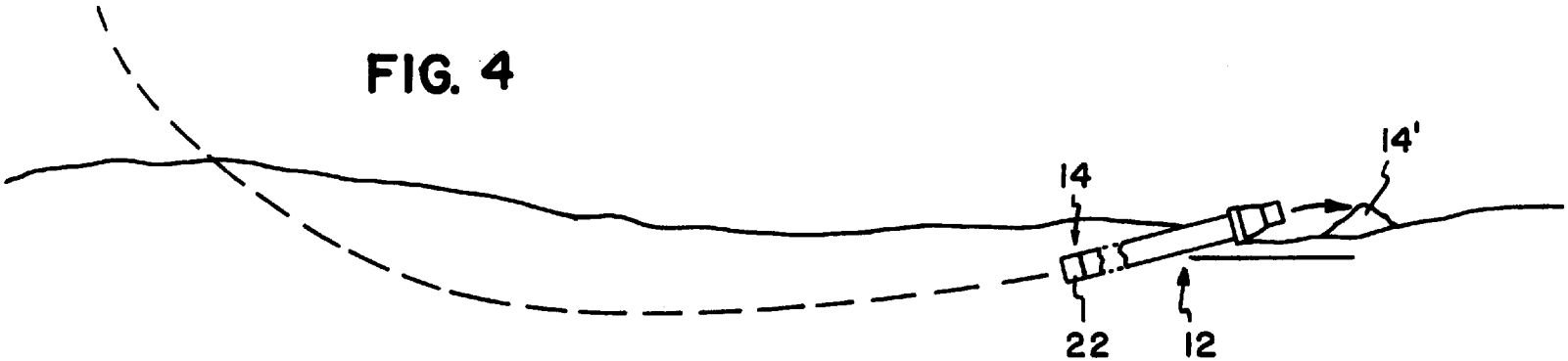
FIG. 4 is a schematic of spoilage being removed from the launch tube of FIG. 3.

During the ramming process, unstable soil 14 will fill lumen 20 of launch tube 12. It is desirable to remove the unstable soil 14 which fills lumen 20 of launch tube 12 periodically during the ramming process. The soil in lumen 20 of launch tube 12 is typically called spoilage. As schematically represented in FIG. 4, an auger with flighting is sent into lumen 20 of launch tube 12. The auger forces the spoilage up the flighting and out the proximal end of launch tube 12 as indicated by 14'. The spoils can be left or can be hauled away. Other methods are also available for clearing spoils from lumen 20 of launch tube 12. It is also recognized that the spoils may be removed from launch tube 12 after launch tube 20 has reached stable soil.

Figure 5:
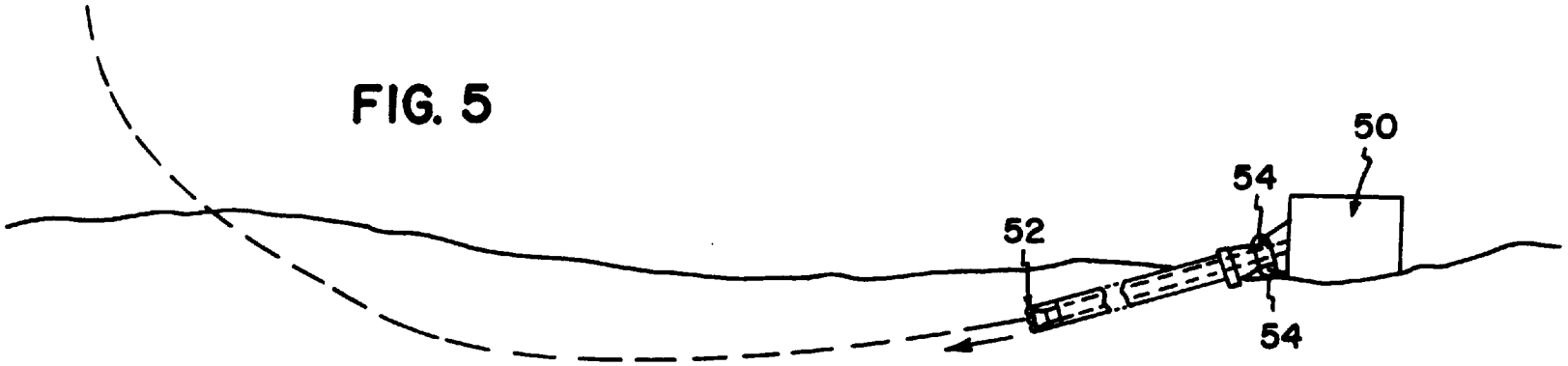
FIG. 5 is a schematic of a directional drilling tool creating a bore.

Once the launch tube 12 is placed it creates a stable bore which, unlike the unstable soil, will not collapse. As illustrated in FIG. 5, a directional drilling tool 50 having a directional drill bit 52 then passes through launch tube 12 to drill a bore. An example of a directional drilling device is American Auger's DD, which may be purchased from American Auger. The directional drilling bit 52 can then travel through the launch tube and bore through the stable soil or bedrock in the desired manner. An advantage of launch tube 12 is that the directional drilling bit 52 will not deviate from the path set by launch tube 12.

It has been found that when using a launch tube as described herein, it may be unnecessary to provide directional drilling anchors, which saves significant time and expense. In the prior art, directional drilling devices were anchored to the ground by first driving an H beam into the soil as far as possible. Once the beam was driven into the soil, a hole was dug around the beam and concrete was poured in the hole. The directional drilling device may then be attached to the H beams, and they anchored the device so that it did not move during the directional drilling operation. The process of ramming the H beams into the ground and pouring the concrete typically takes two to four days to complete.

In the preferred embodiment, ears 54 or eyelets may be welded to the exposed portion of the launch tube at its proximal end 18 and the directional drilling device 50 may be attached directly to launch tube 12. Ears 54 may be welded to the exposed portion of the launch tube at its proximal end in less than an hour as compared against the days it takes to construct the drilling anchors. Using such an arrangement it has been found that the directional drilling device can push 160,000 lbs. without use of separate anchors as known in the prior art.

When the directional drilling tools travels through a launch tube it is easy to control when it drills through bedrock.

In use, the present device and method can achieve a bore in unstable soil under a body of water in a matter of days, as compared to the months it took in the prior art.

The directional drill bit 52 will pass through the bedrock and back to the surface. In many instances, the directional drill bit 52 may exit sufficiently remote from launch tube 12 such that it exits through stable soil. However, if the directional drill exits in unstable soil, it may be necessary to place an exit tube 60 through which the directional drill may pass back to the surface. Such an arrangement is illustrated in FIG. 7. Exit tube 60 would be placed in the same manner as launch tube 12. The directional drill would be guided to the distal end of exit tube 60, and there through to the surface.

If the directional drill cannot create a bore of sufficient diameter to accommodate the pipeline to be placed, it may be necessary to back ream the bore to a larger diameter. To back ream the bore, a back reaming tool (not shown) is passed through launch tube 12 and into the bore. The tool then reams the bore to a larger diameter. The spoils from such a reaming process are then removed from the bore.

Figure 6:
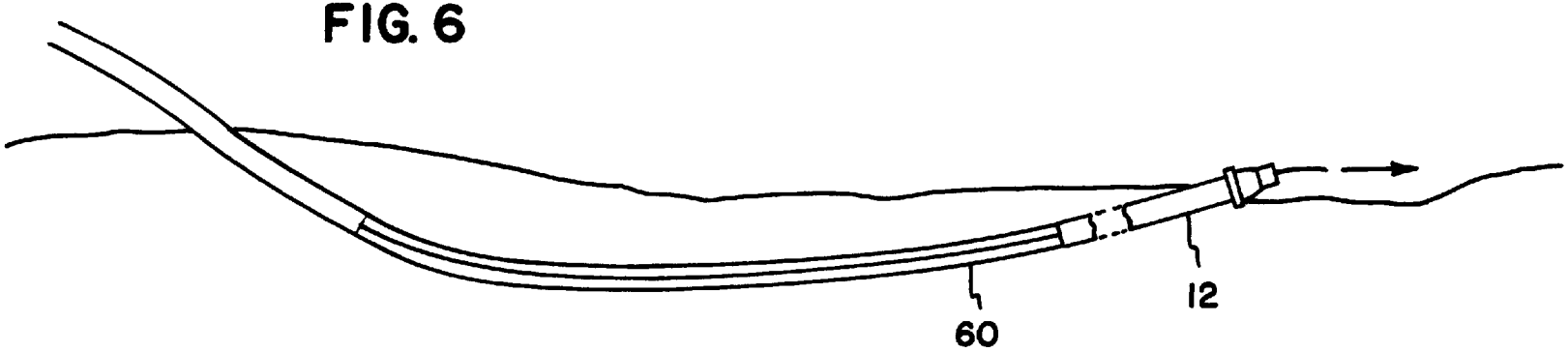
FIG. 6 is a schematic of a pipe being placed in the bore of FIG. 5.

As best shown in FIG. 6, once a bore has been established using a directional drill, a pipe 60 may be placed in the bore. The bore may be cut as to receive a single pipe or multiple pipes. As an example, if a 14-inch diameter bore is created, an 8-inch and a 6-inch pipe may be placed.

It has been found that the present invention is far more efficient than the methods of the prior art.

Further, it is to be understood that even though numerous characteristics and advantages of the invention have been set forth in the foregoing description, together with details of the structure and function of the invention, the disclosure is illustrative only. Changes may be made in detail, for example in matters of shape, size and arrangement of parts.

What is claimed is:

1. A launch tube for ramming into soil and for use with a directional drilling device, the launch tube comprising:

an elongated tube having a distal end, a proximal end and a lumen therebetween, the tube having an inner diameter and an outer diameter;

a first tubular shoe having an outer diameter equal to or less than the inner diameter of the elongated tube, the first shoe being plug welded within the elongated tube at its distal end; and a second tubular shoe having an inner diameter equal to or greater than the outer diameter of the elongated tube, the second shoe being plug welded to the elongated tube at its distal end.

2. A launch tube as in claim 1 wherein the first and second shoes have associated lengths, and the length of the first shoe is shorter than the length of the second shoe.

3. A launch tube as in claim 2 wherein the plug welds attaching the first and second shoes to the elongated tube form a diamond pattern.

4. A launch tube as in claim 1 wherein the first and second shoes are configured to force soil both into and out of the lumen of the elongated tube.

5. A method for placing an underground pipe beneath the surface of the earth comprising:

providing a launch tube having a proximal end and a distal end;

ramming the launch tube into soil at a predetermined angle;

clearing soil from the lumen of the launch tube;

passing a directional drilling tool through the lumen of the launch tube;

drilling a bore with the directional drilling tool, the bore passing from the distal end of the launch tube back to the surface; and passing the underground pipe through the launch tube and into the bore.

6. A method as in claim 5 wherein the launch tube has a cutting shoe attached to its distal end.

7. A method as in claim 6 wherein the cutting shoe comprises an inner shoe and outer shoe which are plug welded to the distal end of the launch tube.

8. A method as in claim 6 further comprising the steps of:

providing an exit tube having a proximal end, a distal end and a lumen therebetween;

ramming the exit tube into the soil at a predetermined angle;

clearing soil from the lumen of the exit tube;

passing a directional drilling tool through the lumen of the launch tube;

passing the directional drilling tool from the bore out the exit tube to the surface of the earth; and passing the underground pipe through the launch tube and into the bore and out the exit tube.

9. A method as in claim 5 further comprising the step of:

welding ears onto an exposed portion of the launch tube; and anchoring the directional drilling tool to the exposed portion of the launch tube.

10. A method as in claim 5 further comprising passing a reamer through the bore to increase the size of the bore.

11. A method as in claim 5, wherein the launch tube is rammed through unstable soil to a position where the distal end of the launch tube reaches stable soil.

* * * * *